US007748968B2

(12) United States Patent
Morozumi

(10) Patent No.: US 7,748,968 B2
(45) Date of Patent: Jul. 6, 2010

(54) TWO-CYLINDER ROTARY COMPRESSOR WITH SUCTION PIPES

(75) Inventor: Naoya Morozumi, Kawasaki (JP)

(73) Assignee: Fujitsu General Limited, Kawasaki-Shi, Kanagawa-Ken (JP)

( * ) Notice: Subject to any disclaimer, the term of this patent is extended or adjusted under 35 U.S.C. 154(b) by 0 days.

(21) Appl. No.: 12/078,821

(22) Filed: Apr. 7, 2008

(65) Prior Publication Data

US 2008/0267804 A1 Oct. 30, 2008

(30) Foreign Application Priority Data

Apr. 27, 2007 (JP) ..... 2007-118914

(51) Int. Cl.
*F03C 2/00* (2006.01)
*F03C 4/00* (2006.01)
*F04C 2/00* (2006.01)

(52) U.S. Cl. ..... 418/11; 418/60; 418/97; 418/270; 418/DIG. 1; 417/410.3

(58) Field of Classification Search ..... 418/11, 418/60, 63, 97, 270, DIG. 1; 417/295, 410.3, 417/540, 542

See application file for complete search history.

(56) References Cited

U.S. PATENT DOCUMENTS 4,764,097 A * 8/1988 Hirahara et al. ..... 418/60
2005/0069422 A1* 3/2005 Lee et al. ..... 417/410.3

FOREIGN PATENT DOCUMENTS

JP 03194185 A * 8/1991 ..... 418/60
JP 05087074 A * 4/1993 ..... 418/11
JP 06026479 A * 2/1994 ..... 418/11
JP 2006242164 A * 9/2006
WO WO 2005124156 A1 * 12/2005

* cited by examiner

*Primary Examiner*—Theresa Trieu
(74) *Attorney, Agent, or Firm*—Manabu Kanesaka

(57) ABSTRACT

In a two-cylinder rotary compressor, two compressing sections accommodated in a compressor body and an accumulator are connected to each other by two suction pipes each formed with an L-shaped bend part in the intermediate pipe part thereof. To reduce a pressure loss caused by the flow resistance of a refrigerant sucked from the accumulator into the compressor, the L-shaped bend parts of the two suction pipes are arranged on different imaginary planes including the center axis line of the compressor body.

4 Claims, 7 Drawing Sheets

TWO-CYLINDER ROTARY COMPRESSOR WITH SUCTION PIPES

TECHNICAL FIELD

The present invention relates to a rotary compressor used for a heat pump system for an air conditioner and the like. More particularly, it relates to a technique for reducing a pressure loss caused by the flow resistance of a refrigerant that is sucked from an accumulator into a compressor, and thereby increasing the efficiency of compressor.

BACKGROUND ART

In a rotary compressor used for a heat pump system for an air conditioner and the like, an accumulator is generally provided at the side of a compressor body. In the case where a liquid refrigerant is mixed in the refrigerant returned from a refrigerating cycle, the liquid refrigerant is accumulated in the accumulator, and only a gas refrigerant is sucked into the compressor, by which the compressor is prevented from being damaged by liquid compression etc.

The gas refrigerant in the accumulator is guided to a compressing section in the compressor body through a suction pipe. As the suction pipe, an L-shaped pipe one end side of which penetrates the lower end part of the accumulator and the other end side of which penetrates the side wall of the compressor body is usually used.

As the rotary compressor, there is available a two-cylinder rotary compressor provided with two compressing sections laminated vertically in the compressor body.

FIG. 8 shows the configuration of a two-cylinder rotary compressor disclosed in Japanese Patent Application Publication No. 2001-99083 as a related art of the present invention. Hereunder, this two-cylinder rotary compressor is explained.

In the two-cylinder rotary compressor, two compressing sections 20*a* and 20*b* laminated vertically in a closed vessel 10 of the compressor body are connected to an accumulator 7 via two suction pipes 40*a* and 40*b*, respectively, each consisting of an L-shaped pipe.

In the conventional two-cylinder rotary compressor including the above-mentioned rotary compressor of related art, the two suction pipes 40*a* and 40*b* are generally laid so as to lie one upon another vertically in plan view of FIG. 8 because the suction holes of the compressing sections 20*a* and 20*b* are provided so as to be directed toward the same direction.

That is to say, both of the two suction pipes 40*a* and 40*b* are present in an imaginary plane including the center axis line of the closed vessel 10 and the center axis line of the accumulator 7, and one suction pipe 40*a* corresponding to the upper compressing section 20*a* is laid so as to turn on the inside of the other suction pipe 40*b* corresponding to the lower compressing section 20*b*.

In such a piping mode, the bend radius of the L-shaped bend part of one suction pipe 40*a* laid on the inside is smaller than that of the other suction pipe 40*b* laid on the outside.

Therefore, there arises a problem in that the flow resistance of the refrigerant in one suction pipe 40*a* increases, and therefore the suction pressure loss increases, thereby greatly decreasing the efficiency of compressor.

The problem arises more remarkably as the quantity of circulating refrigerant increases especially in a compressor having a high capacity, a variable speed compressor whose rated rotational speed is set so as to be higher than the commercial power source frequency, and the like.

As one method for solving the above-described problem, it can be thought that the inside diameter of the suction pipe is increased, that is, a large-diameter pipe is used.

However, in the case where a large-diameter pipe is used as the suction pipe, if the bend radius is small, the thickness of the pipe decreases partially, or the residual stress remaining inside increases, whereby the burst pressure resistance of pipe at the time when a pressure is applied into the pipe may decrease.

For this reason, in the case where a large-diameter pipe is used as the suction pipe, the bend radius of the L-shaped bend part must be increased. Accordingly, the diameter of the accumulator must be increased, or the accumulator must be disposed farther apart from the compressor body. Therefore, there arises a problem in that a large mounting space is required in mounting the compressor on a system product such as an air conditioner.

SUMMARY OF THE INVENTION

Accordingly, an object of the present invention is to provide a rotary compressor that can reduce a pressure loss caused by the flow resistance of a refrigerant sucked from an accumulator into the compressor and does not require a large mounting space in mounting the compressor on a system product such as an air conditioner.

To achieve the above object, the present invention provides a rotary compressor including a compressor body in which two compressing sections laminated vertically and a motor for driving the compressing sections are accommodated in a cylindrical closed vessel installed vertically; a cylindrical accumulator disposed vertically at the side of the compressor body; and two suction pipes connecting the two compressing sections to the accumulator, in which one end of each of the two suction pipes penetrates the lower end part of the accumulator and is open in the upper part in the accumulator, the other end thereof penetrates the side wall of the closed vessel and is connected to a suction hole of each of the two compressing sections, and an L-shaped bend part is formed in an intermediate pipe part, wherein the L-shaped bend parts of the two suction pipes are arranged on different imaginary planes including the center axis line of the compressor body.

According to this configuration, the L-shaped bend parts of the two suction pipes do not interfere with each other on the same imaginary plane including the center axis line of the compressor body, so that the bend radius of the L-shaped bend part of the suction pipe connected to the upper compressing section can be made larger than that in the conventional example explained before with reference to FIG. 8.

Therefore, the pressure loss caused by the flow resistance of the refrigerant sucked from the accumulator into the compressor can be reduced.

Also, the diameter of the accumulator need not be increased, or the accumulator need not be arranged apart from the compressor body. Therefore, the mounting space in mounting the compressor on a system product such as an air conditioner can be decreased.

Further, as the suction pipe, a pipe having a large diameter of a degree capable of allowing the bend radius of the L-shaped bend part can be used. Thereby, the pressure loss in the whole region of suction pipe is reduced, and therefore the efficiency of compressor can further be improved.

As preferable modes, the present invention embraces a mode in which the two suction pipes penetrate the lower end part of the accumulator at positions at an approximately equal distance from the center axis line of the compressor body, and the L-shaped bend parts of the two suction pipes have almost the same bend radius, and a mode in which the two suction pipes penetrate the lower end part of the accumulator at positions shifted from the center axis line of the accumulator to the opposite side of the compressor body.

According to these modes, for both of the two suction pipes, the bend radiuses of the L-shaped bend parts thereof can be increased further, so that the effect of decreasing the suction pressure loss is increased, by which the efficiency of compressor can further be improved.

Also, the present invention embraces a mode in which the suction holes of the two compressing sections are arranged at relatively different positions along the circumferential direction of the closed vessel, and accordingly the two suction pipes penetrate the side wall of the closed vessel at different positions in the circumferential direction of the closed vessel.

According to this mode, the L-shaped bend part of the suction pipe connected to the lower compressing part need not be inclined slantwise to keep it away from the L-shaped bend part of the suction pipe connected to the upper compressing part, and also a second bend part need not be formed. The positions at which the suction pipes penetrate the accumulator can be made in different directions with the center axis line of the compressor body being the center.

DETAILED DESCRIPTION

Figure 1:
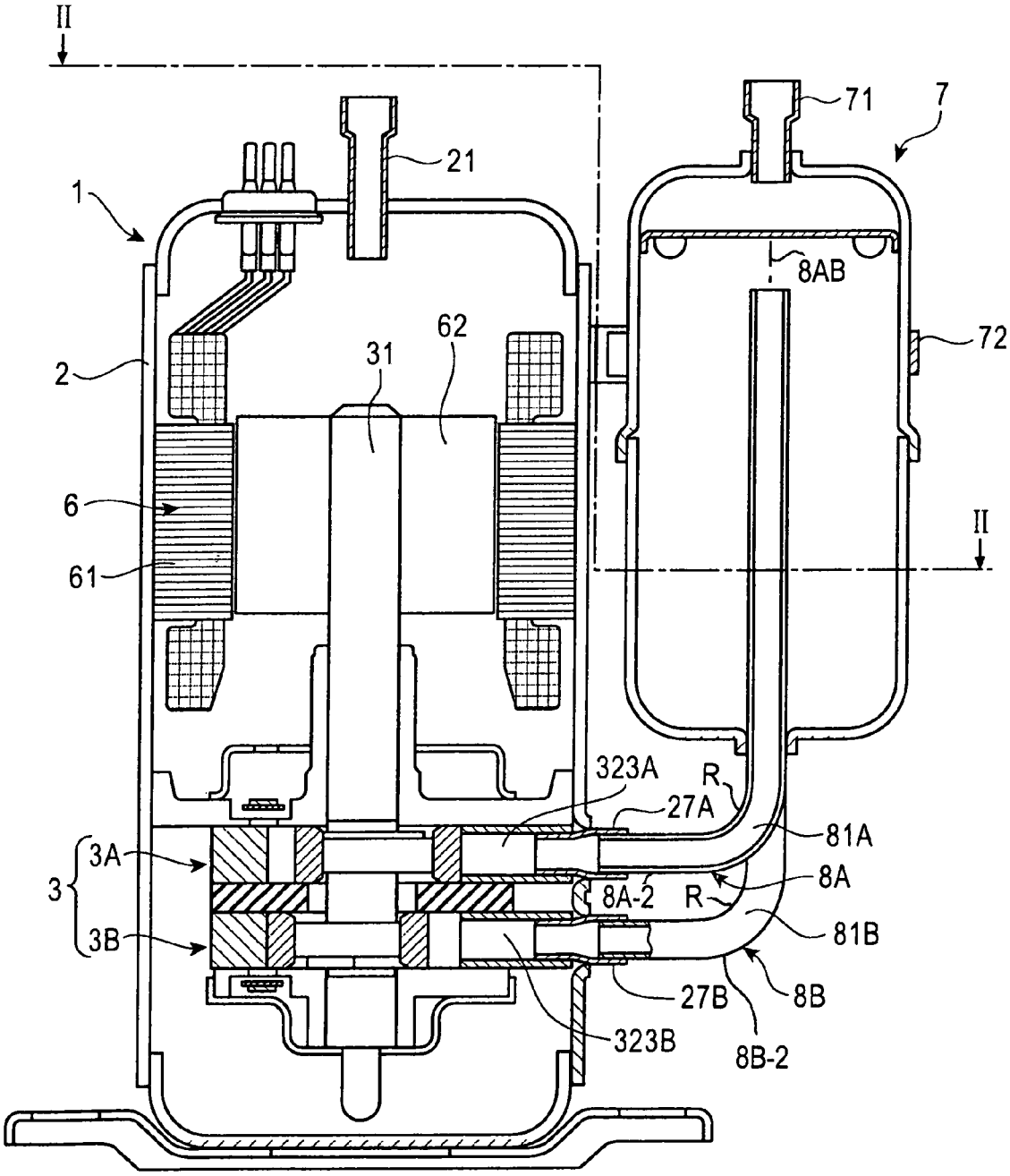
FIG. 1 is a longitudinal sectional view of a rotary compressor in accordance with a first embodiment of the present invention.

First, a rotary compressor in accordance with a first embodiment of the present invention is explained with reference to FIGS. 1 to 3.

As a basic configuration, this rotary compressor includes a compressor body 1 and an accumulator 7.

The compressor body 1 has a cylindrical closed vessel 2 the upper and lower parts of which are closed by respective end caps. In this embodiment, substantially in the center of the upper end cap, a refrigerant discharge pipe 21 is provided.

This rotary compressor is used in such a manner as to be assembled in a heat pump system such as an air conditioner, not shown. At this time, the closed vessel 2 is installed vertically as shown in FIGS. 1 and 3. In other words, the closed vessel 2 is disposed with the refrigerant discharge pipe 21 provided on the upper end cap being directed upward.

The closed vessel 2 accommodates a compressing section 3 and a motor 6 for driving the compressing section 3. Since this rotary compressor is of a two-cylinder type, the compressing section 3 includes two compressing sections 3A and 3B.

Since the compressing sections 3A and 3B are laminated vertically, in the explanation below, one compressing section 3A arranged on the upper side is sometimes called an upper compressing section, and the other compressing section 3B arranged on the lower side is sometimes called a lower compressing section.

The motor 6 includes a stator 61 and a rotor 62. The stator 61 is integrally fixed on the inner peripheral surface of the closed vessel 2, and the rotor 62 is rotatably disposed in the stator 61.

In the center hole of the rotor 62, one end of a drive shaft 31 that is common to the compressing sections 3A and 3B is integrally inserted by press fitting or other means. The center axis line of the compressor body 1 (the closed vessel 2) coincides with the rotation axis line of the drive shaft 31.

The accumulator 7 consists of a cylindrical body the upper and lower parts of which are closed by respective lid plates. The accumulator 7 is disposed vertically at the side of the compressor body 1, and is supported on the compressor body 1 by using a fixing band 72.

To the upper end part of the accumulator 7, a refrigerant return pipe 71 through which the refrigerant is returned from a refrigerating cycle, not shown, is connected. In this embodiment, the center axis line of the accumulator 7 coincides with the axis line of the refrigerant return pipe 71.

In the accumulator 7, a liquid refrigerant contained in the refrigerant returned from the refrigerating cycle is separated, and only a gas refrigerant is supplied from the accumulator 7 into the upper compressing section 3A and the lower compressing section 3B.

For this purpose, two suction pipes of a first suction pipe 8A for the upper compressing section 3A and a second suction pipe 8B for the lower compressing section 3B are used.

The first suction pipe 8A is configured so that one end thereof penetrates the lower end part of the accumulator 7 and is open to the upper part in the accumulator 7, the other end thereof penetrates the side wall of the closed vessel 2 and is connected to a suction hole 323A of the upper compressing section 3A, and the intermediate pipe part thereof has an L-shaped bend part 81A.

Similarly, the second suction pipe 8B is configured so that one end thereof penetrates the lower end part of the accumulator 7 and is open to the upper part in the accumulator 7, the other end thereof penetrates the side wall of the closed vessel 2 and is connected to a suction hole 323B of the lower compressing section 3B, and the intermediate pipe part thereof has an L-shaped bend part 81B.

In this embodiment, the suction pipes 8A and 8B are connected to the suction holes 323A and 323B via suction connection pipes 27A and 27B penetrating the closed vessel 2, respectively.

As shown in FIG. 1, the L-shaped bend part 81A of the first suction pipe 8A is disposed at a position above the L-shaped bend part 81B of the second suction pipe 8B. In the present invention, however, both of the L-shaped bend parts 81A and 81B have the same bend radius.

Figure 2:
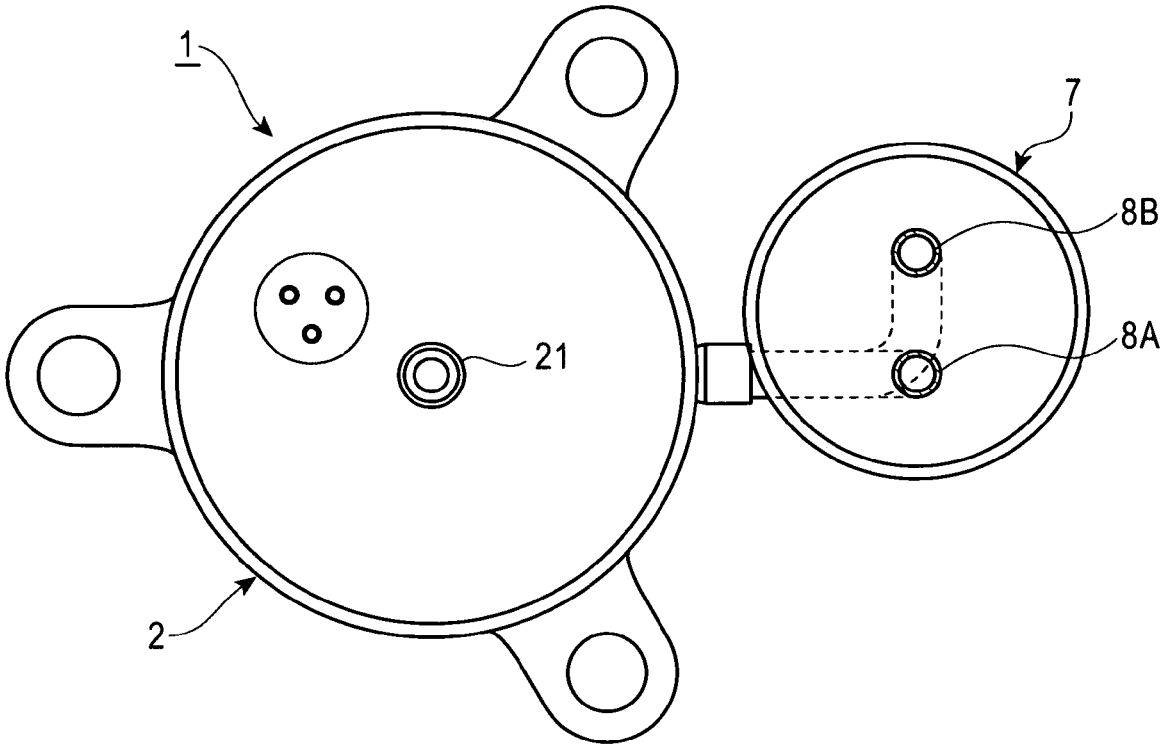
FIG. 2 is a plan view of a rotary compressor in accordance with a first embodiment of the present invention, including a cross section along the line A-A of FIG. 1.

Therefore, in this embodiment, as shown in FIG. 2, the straight lines connecting the respective pipe center axis lines of pipe parts of the first suction pipe 8A and the second suction pipe 8B, which are pulled in from the lower end part of the accumulator 7, to the center axis line of the compressor body 1 do not coincide with each other.

Also, in the accumulator 7, the first suction pipe 8A and the second suction pipe 8B are preferably arranged at positions at an almost equal distance from the center axis line of the compressor body 1.

Figure 3:
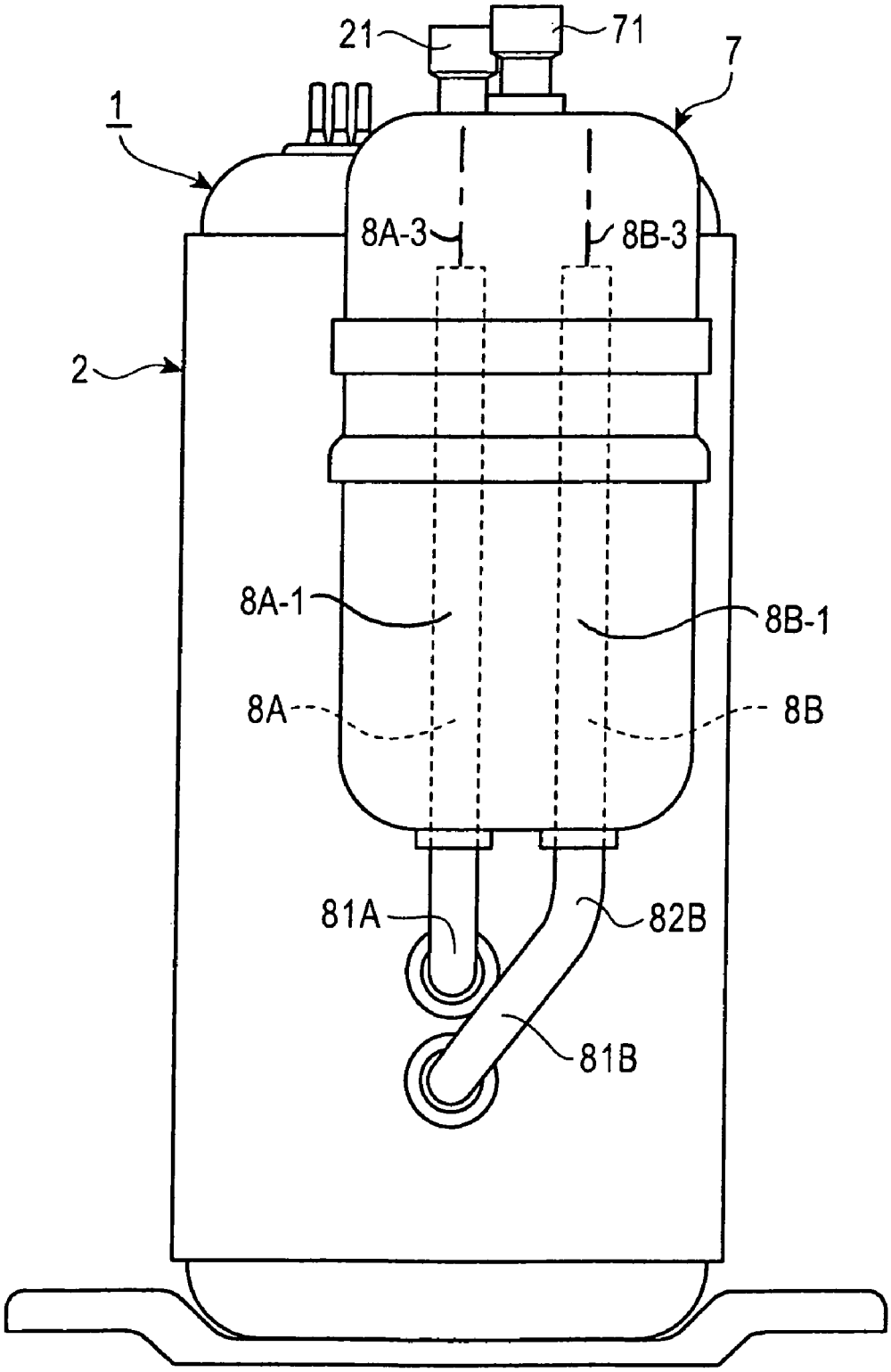
FIG. 3 is a side view of a rotary compressor in accordance with a first embodiment of the present invention, viewed from the accumulator side.

By this arrangement mode, as shown in FIG. 3, the L-shaped bend parts 81A of the first suction pipe 8A for the upper compressing section 3A is disposed almost vertically, whereas the L-shaped bend part 81B of the second suction pipe 8B for the lower compressing section 3B is disposed in a slantwise direction (in FIG. 3, in the slantwise right upward direction) so as to keep away from the L-shaped bend parts 81A. Therefore, both of the L-shaped bend parts 81A and 82B can have the same bend radius.

The second suction pipe 8B has a second bend part 82B of an obtuse angle between the L-shaped bend part 81B and the lower end part of the accumulator 7. Thereby, the second suction pipe 8B is configured so as to penetrate the lower end part of the accumulator 7 vertically.

Namely, the first suction pipe 8A connects the upper compressing section to the accumulator, and includes a first vertical portion 8A-1 penetrating a lower end of the accumulator and opening inside the accumulator, a first horizontal portion 8A-2 penetrating the vessel and connected to a suction hole of the upper compressing section, and the first bent portion 81A with an L-shape situated between the first vertical portion 8A-1 and the first horizontal portion 8A-2.

The second suction pipe 8B connects the lower compressing section to the accumulator, and includes a second vertical portion 8B-1 penetrating the lower end of the accumulator and opening inside the accumulator, a second horizontal portion 8B-2 penetrating the vessel and connected to a suction hole of the lower compressing section, and the second bent portion 81B with an L-shape situated between the second vertical portion 8B-1 and the second horizontal portion 8B-2.

The first horizontal portion 8A-2, the first vertical portion 8A-1, and the first bent portion 81A are located in a first vertical plane 8A-3. The second horizontal portion 8B-2 is parallel to the first horizontal portion 8A-2, has a length substantially the same as that of the first horizontal portion 8A-2 and is located in the first vertical plane 8A-3.

The second vertical portion 8B-1 is parallel to the first vertical portion 8A-1, and is located in a second vertical plane 8B-3 different from the first vertical plane 8A-3. The second bent portion 81B extends obliquely upwardly from the second horizontal portion 8B-2 to the second vertical portion 8B-1 to avoid interference with the first suction pipe.

The first and second vertical portions 8A-1 and 8B-1 are located in a third vertical plane 8AB (FIG. 1) extending perpendicular to the first vertical plane 8A-3. The second bent portion 81B bent from the second horizontal portion 8B-2 is bent again to be connected to the second vertical section 8B-1. Also, the first bent portion 81A has a bending radius R substantially the same as that of the second bent portion 81B.

Thus, according to the first embodiment, the bend radiuses of both of the L-shaped bend parts 81A and 82B of the first suction pipe 8A and the second suction pipe 8B can be increased without increasing the diameter of the accumulator 7 or without arranging the accumulator 7 at a far distance from the compressor body 1.

Also, as the first suction pipe 8A and the second suction pipe 8B, a pipe having a large diameter of a degree capable of allowing the bend radius from the viewpoint of working efficiency can be used, and the suction pressure loss is reduced, whereby the efficiency of compressor can be improved.

In the above-described first embodiment, only the L-shaped bend part 81B of the second suction pipe 8B is disposed in the slantwise direction. However, the L-shaped bend part 81A of the first suction pipe 8A or both of the L-shaped bend parts 81A and 82B may be disposed in the slantwise direction.

Next, a second embodiment of the present invention is explained with reference to FIG. 4.

In the second embodiment, the same reference symbols are applied to elements that are the same as those in the first embodiment, and the detailed explanation thereof is omitted.

Figure 4:
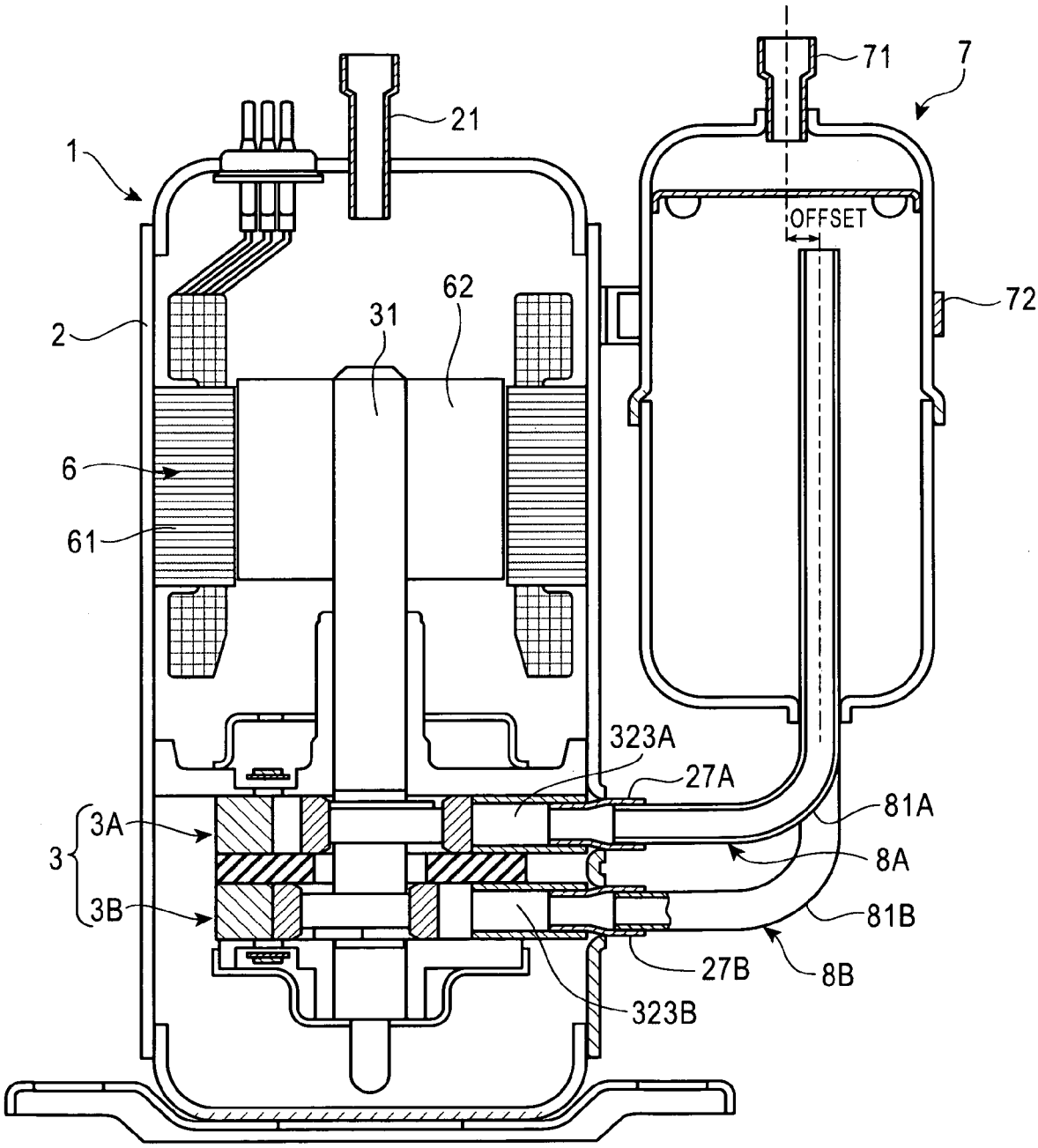
FIG. 4 is a longitudinal sectional view of a rotary compressor in accordance with a second embodiment of the present invention.

In the second embodiment, the bend radiuses of the L-shaped bend parts 81A and 81B of the first suction pipe 8A and the second suction pipe 8B are made the same as in the first embodiment, and additionally, as shown in FIG. 4, the first suction pipe 8A and the second suction pipe 8B are caused to penetrate the lower end part of the accumulator 7 at positions shifted from the center axis line of the accumulator 7 to the opposite side of the compressor body 1.

Therefore, according to the second embodiment, the bend radiuses of the L-shaped bend parts 81A and 82B of the first suction pipe 8A and the second suction pipe 8B can be increased further, so that the suction pressure loss is reduced further, whereby the efficiency of compressor can be improved further.

Next, a third embodiment of the present invention is explained with reference to FIGS. 5 to 7. In the third embodiment, the same reference symbols are applied to elements that are the same as those in the first embodiment, and the detailed explanation thereof is omitted.

Figure 5:
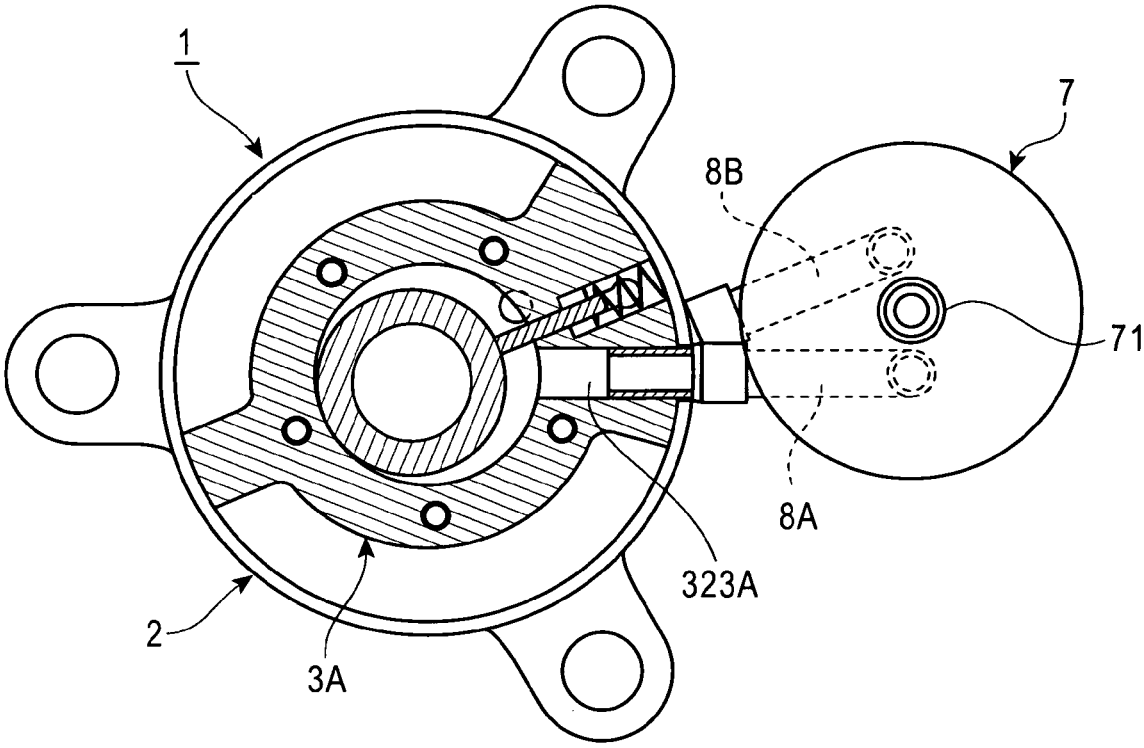
FIG. 5 is a sectional view showing an upper compressing section of a rotary compressor in accordance with a third embodiment of the present invention.
Figure 6:
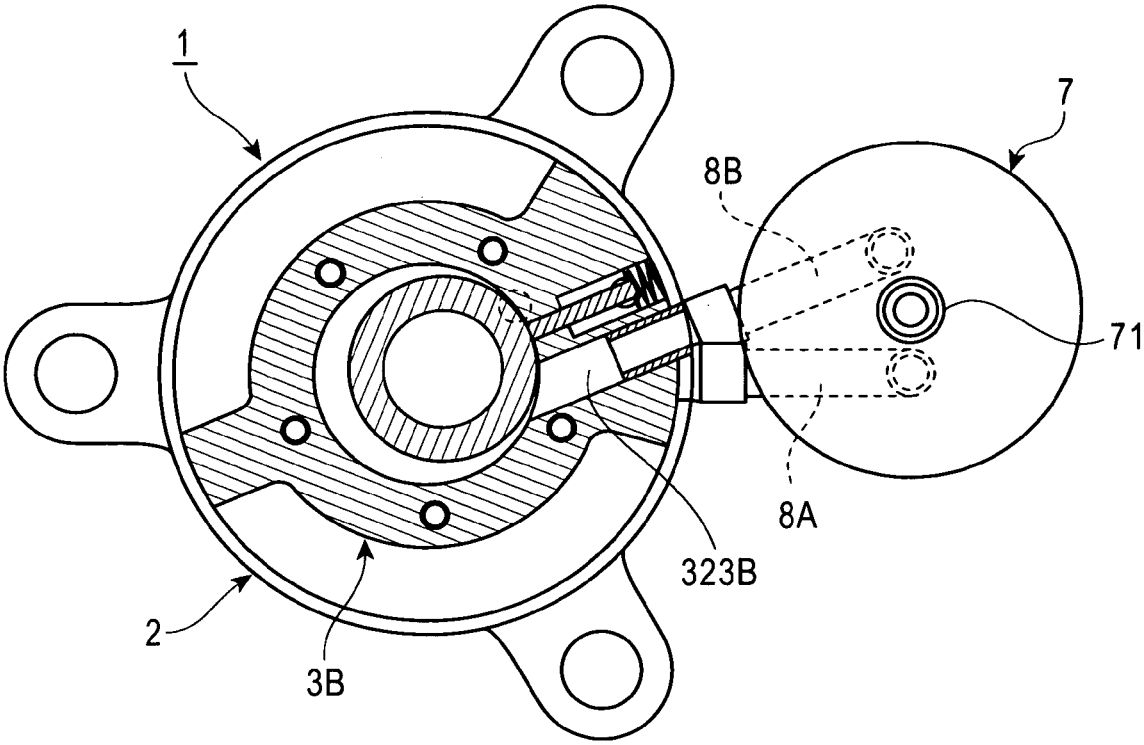
FIG. 6 is a sectional view showing a lower compressing section of a rotary compressor in accordance with a third embodiment of the present invention.
Figure 7:
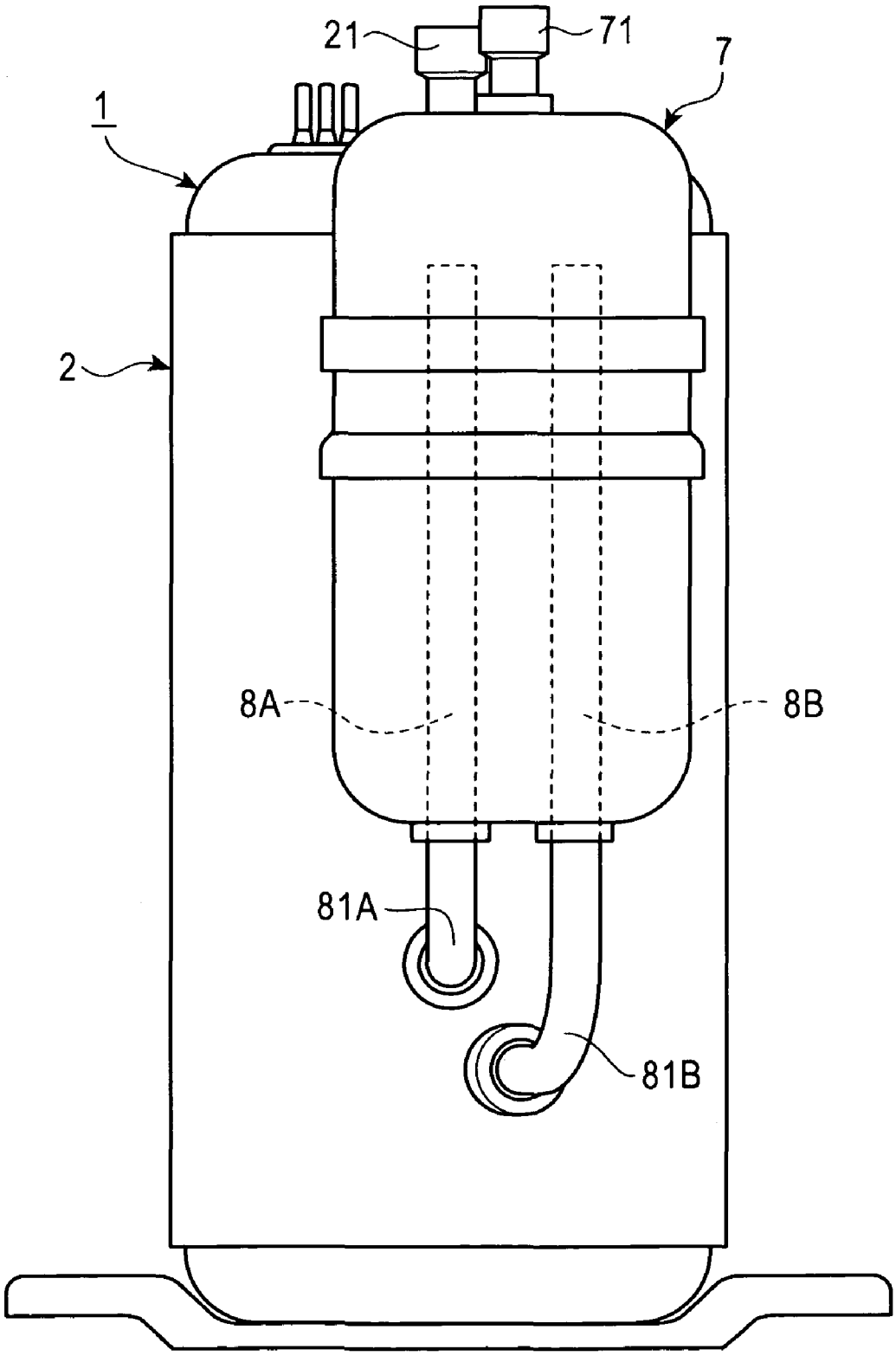
FIG. 7 is a side view of a rotary compressor in accordance with a third embodiment of the present invention, viewed from the accumulator side.
Figure 8:
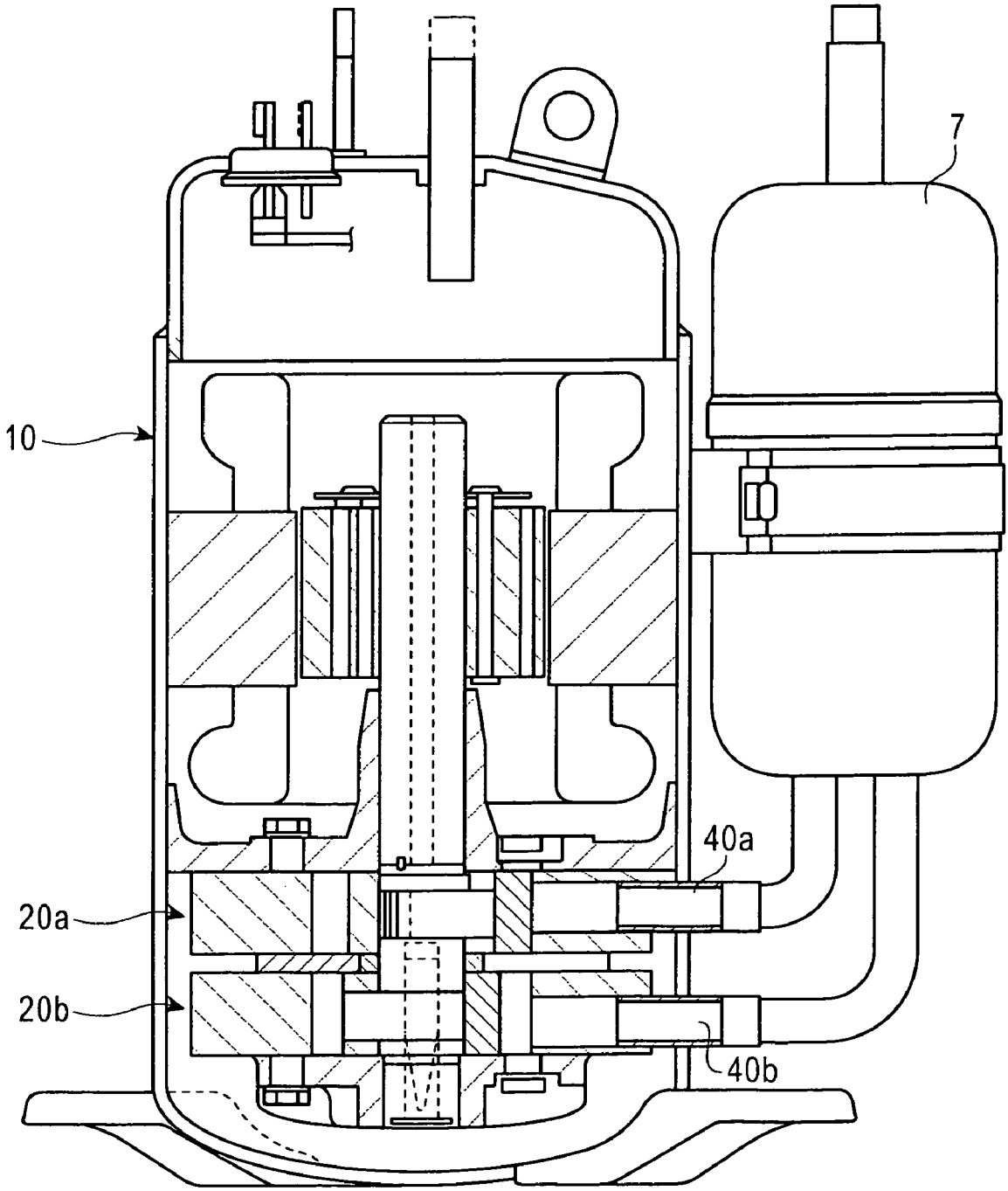
FIG. 8 Prior Art
FIG. 8 is a longitudinal sectional view of a rotary compressor in accordance with a conventional example.

In the third embodiment, as can be seen from the comparison of FIG. 5 and FIG. 6, the positions of the suction hole 323A of the upper compressing section 3A and the suction hole 323B of the lower compressing section 3B are shifted relatively along the circumferential direction of the closed vessel 2. Accordingly, as shown in FIG. 7, the locations at which the first suction pipe 8A for the upper compressing section 3A and the second suction pipe 8B for the lower compressing section 3B penetrate the closed vessel 2 are different in the circumferential direction of the closed vessel 2.

According to this configuration, for example, the L-shaped bend part 81B of the second suction pipe 8B need not be inclined slantwise to form the second bend part as shown in FIG. 3 before. The L-shaped bend parts 81A and 81B of the first suction pipe 8A and the second suction pipe 8B can be arranged on different imaginary planes including the center axis line of the compressor body 1 in the state in which the L-shaped bend parts 81A and 81B are directed toward a substantially vertical direction. Therefore, the fabrication cost of the suction pipes can be reduced.

In order to shift the positions of the suction hole 323A of the upper compressing section 3A and the suction hole 323B of the lower compressing section 3B, either of the two methods described below may be used.

In the first method, the hole opening positions of the suction holes 323A and 323B are changed in the upper compressing section 3A and the lower compressing section 3B.

In the second method, the hole opening positions of the suction holes 323A and 323B are made the same in the upper compressing section 3A and the lower compressing section 3B, and the upper compressing section 3A and the lower compressing section 3B are shifted relatively when they are laminated. In the third embodiment, the first method is adopted.

The above is an explanation of the configuration of the present invention given by using specific embodiments. The present invention is not limited to the above-described embodiments. The scope of the present invention should be the appended claims and a scope equivalent thereto.

The present application is based on, and claims priority from, Japanese Application Serial Number JP2007-118914, filed Apr. 27, 2007 the disclosure of which is hereby incorporated by reference herein in its entirety.

The invention claimed is:

1. A rotary compressor comprising:

a cylindrical closed vessel;

a compressor body installed in the vessel, and having upper and lower compressing sections arranged vertically, and a motor for driving the compressing sections;

a cylindrical accumulator disposed vertically at one side of the vessel;

a first suction pipe for connecting the upper compressing section to the accumulator, said first suction pipe having a first vertical portion penetrating a lower end of the accumulator and opening inside the accumulator, a first horizontal portion penetrating the vessel and connected to a suction hole of the upper compressing section, and a first bent portion with an L-shape situated between the first vertical portion and the first horizontal portion; and a second suction pipe for connecting the lower compressing section to the accumulator, said second suction pipe having a second vertical portion penetrating the lower end of the accumulator and opening inside the accumulator, a second horizontal portion penetrating the vessel and connected to a suction hole of the lower compressing section, and a second bent portion with an L-shape situated between the second vertical portion and the second horizontal portion, wherein the first horizontal portion, the first vertical portion, and the first bent portion are located in a first vertical plane, the second horizontal portion is parallel to the first horizontal portion, has a length substantially same as that of the first horizontal portion and is located in the first vertical plane, the second vertical portion is parallel to the first vertical portion, and is located in a second vertical plane different from the first vertical plane, and the second bent portion extends obliquely upwardly from the second horizontal portion to the second vertical portion to avoid interference with the first suction pipe.

2. The rotary compressor according to claim 1, wherein the first and second vertical portions are located in a third vertical plane extending perpendicular to the first vertical plane.

3. The rotary compressor according to claim 2, wherein the second bent portion is bent again to be connected to the second vertical section.

4. The rotary compressor according to claim 1, wherein the first bent portion has a bending radius substantially same as that of the second bent portion.

* * * * *